United States Patent [19]

Bouette et al.

[11] 4,185,923

[45] Jan. 29, 1980

[54] METHOD AND APPARATUS FOR PRODUCING INSULATING MATERIAL

[76] Inventors: David W. Bouette, 28 Manor Crescent, Tytherington, Macclesfield, Cheshire; Donald E. Baker, The Shambles, Sugar La., Rushton Spencer, Macclesfield, Cheshire; Fred Cartwright, Roseleigh, Hare La., Pipers Ash, Chester, all of England

[21] Appl. No.: 814,657

[22] Filed: Jul. 11, 1977

[51] Int. Cl.[2] ..... B28C 5/00; B28C 5/12

[52] U.S. Cl. ..... 366/10; 366/66; 366/101

[58] Field of Search ..... 366/3, 10, 13, 101, 366/102; 425/817 R; 366/177, 182, 66

[56] References Cited

U.S. PATENT DOCUMENTS

| | | | |
|---|---|---|---|
| 2,915,301 | 12/1959 | Selden | 366/3 |
| 3,236,504 | 2/1966 | Galer | 366/3 |
| 3,248,093 | 4/1966 | Demaison | 366/13 |
| 3,685,807 | 8/1972 | Campbell | 366/3 |

FOREIGN PATENT DOCUMENTS 1186287 4/1970 United Kingdom .

*Primary Examiner*—Robert W. Jenkins
*Attorney, Agent, or Firm*—Fleit & Jacobson

[57] ABSTRACT

A method and apparatus for providing an insulating material, for example for a building, in which a premix of water and cement is provided, an air foam is formed by introducing air under pressure into a mixture and a foaming agent, and this air foam is introduced into the premix which is then stirred together with the foam, and the resulting mixture is pumped to the site to be insulated.

2 Claims, 5 Drawing Figures

METHOD AND APPARATUS FOR PRODUCING INSULATING MATERIAL

The present invention relates to a method and apparatus for producing insulating material.

Various proposals have been made for making insulating material of aerated concrete, but none are particularly adapted to the production of on-site insulating material of this type.

It is now proposed, according to the present invention, to produce an insulating material by providing a premix of water and cement, introducing into this premix an air foam formed by introducing air under pressure into a mixture of water and a foaming agent, stirring the premix and foam, and feeding the resultant mixture to the site.

With such a method it is possible to produce an insulating material with a relative small and inexpensive apparatus which can, for example, be mounted on a vehicle or a vehicle trailer.

Advantageously, the foam quality if controlled by controlling the density and/or the cell size of the foam. This can be effected by choosing the desired construction e.g. the packing of a foam producing unit. Alternatively and/or additionally it can be effected by controlling the rate of flow of the air introduced under pressure into the mixture.

In certain circumstances it is advantageous for an additional material to be introduced into the premix. Such an additional material may include a reinforcing fibre of glass or textile material. It may also or alternatively in the form of a material such as sand or aggregate.

In certain circumstances it has been found desirable to render the mixture thixotropic, and the additional material may therefore include an agent, such as hydroxy methyl cellulose or carboxy methyl cellulose to render the mixture thixotropic or pseudo-plastic.

Additional material may be added to the already premixed material before or after the introduction of air under pressure. Thus, if desired, where glass fibres are added to the foam material, these may be added as the foam material arrive at the site in the gun.

Although it is primarily intended that the said resultant mixture should be pumped to the site, it may be fed to the site by other means, e.g. by a gravity feed.

The invention also contemplates an apparatus for carrying out the method of the invention. Thus the apparatus according to the invention comprises a supply tank for water and wetting agent, a compressor for producing a compressed air supply, a foaming unit connected to the compressor and supply tank, a slurry tank provided with an agitator connected to the foaming unit and a feed pump for feeding the resulting mixture from the slurry tank to the point of use.

As indicated the whole assembly can readily be mounted on a vehicle or a vehicle trailer. Advantageously, the compressor has an inlet throttle and does not have a conventional air receiver, the air flow being controlled by the inlet throttle. In order to feed the solution of water and foaming agent to the foaming unit the supply tank preferably has, connected to its outlet, a pump, for example a helical gear pump of the type sold under the Registered Trade Mark "Mono Pump".

In a preferred construction the slurry tank is divided into two halves by a central partition and is open at the top to enable the cement and water to be introduced into each half readily. The outlet from the foaming unit is preferably provided with means for alternately introducing the foam to one of the two chambers of the mixing tank. For example suitable valving may be provided or a flexible hose may be utilised. With such construction, two outlet pipes one from each chamber, may be connected via a three-way valve to the feed pump, which again is preferably a Mono pump.

Within the slurry tank the agitating means preferably comprises a horizontal shaft carrying a number of paddles in each chamber, the shaft being rotatable preferably at a relatively low speed.

The slurry tank is preferably connected, via the three-way valve, to a hold tank from which the foamed cement is pumped by the feed pump to the site.

In order that the present invention may more readily be understood, the following description is given, merely by way of example, reference being made to the accompanying drawings in which.

Figure 1:
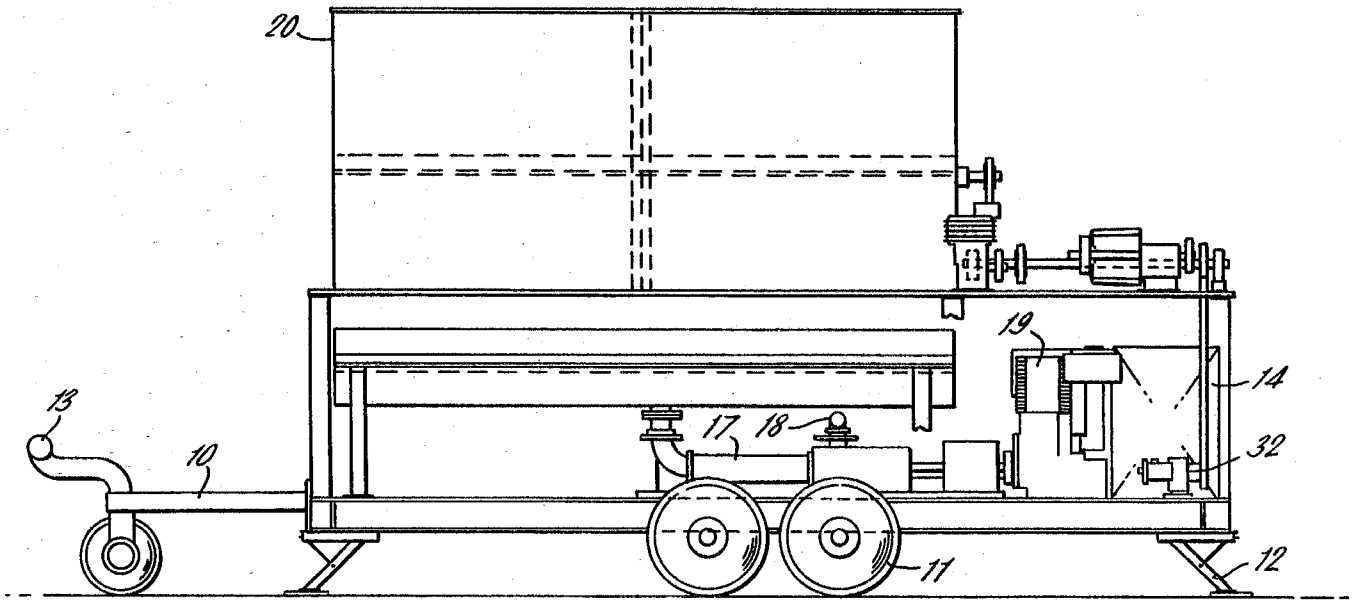
FIG. 1 is a side elevation of one embodiment of apparatus according to the invention.
Figure 2:
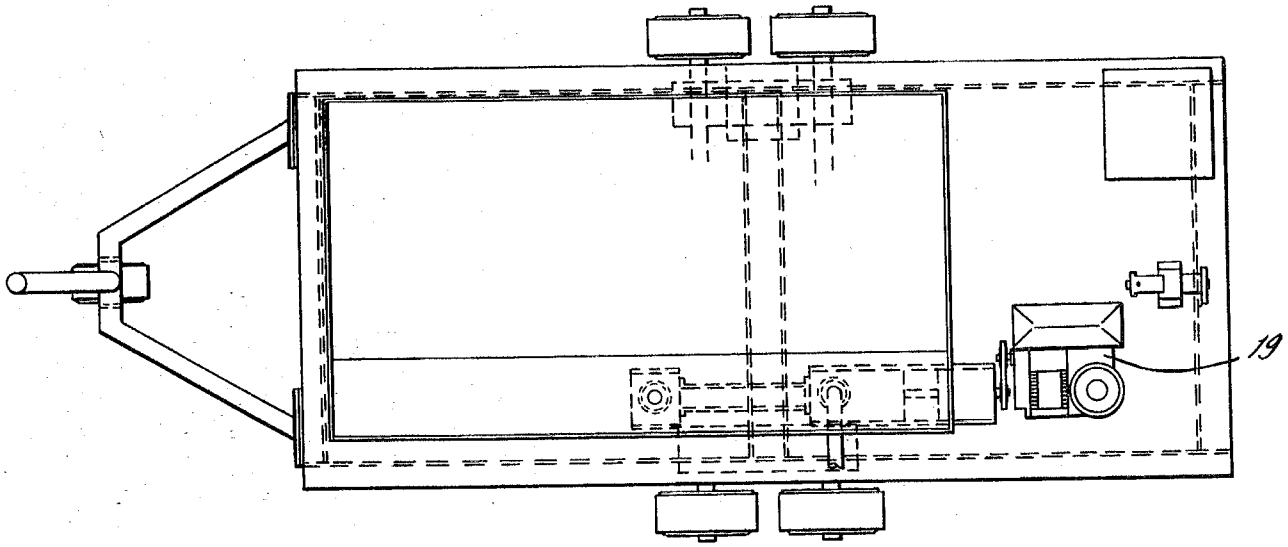
FIG. 2 is a plan view of the bottom deck of the apparatus of FIG. 1.
Figure 3:
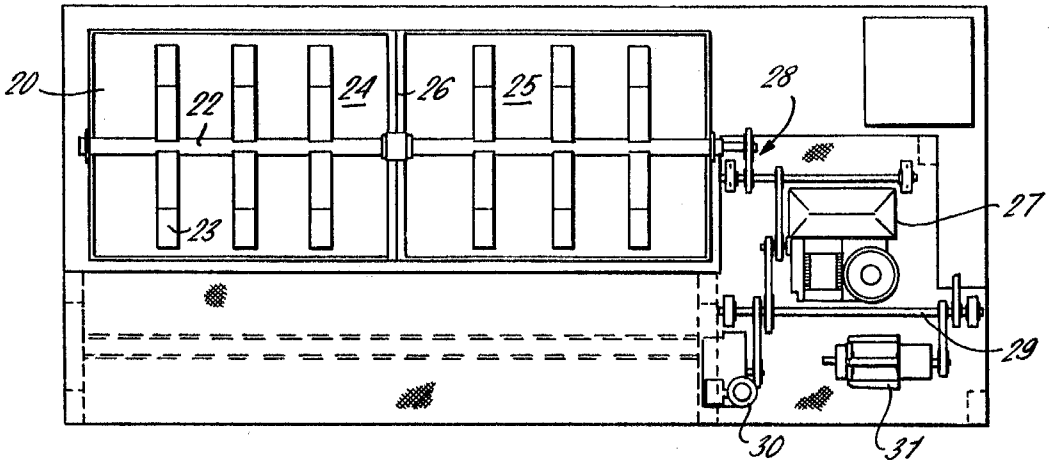
FIG. 3 is a plan view of the top deck of the apparatus of FIG. 1.
Figure 4:
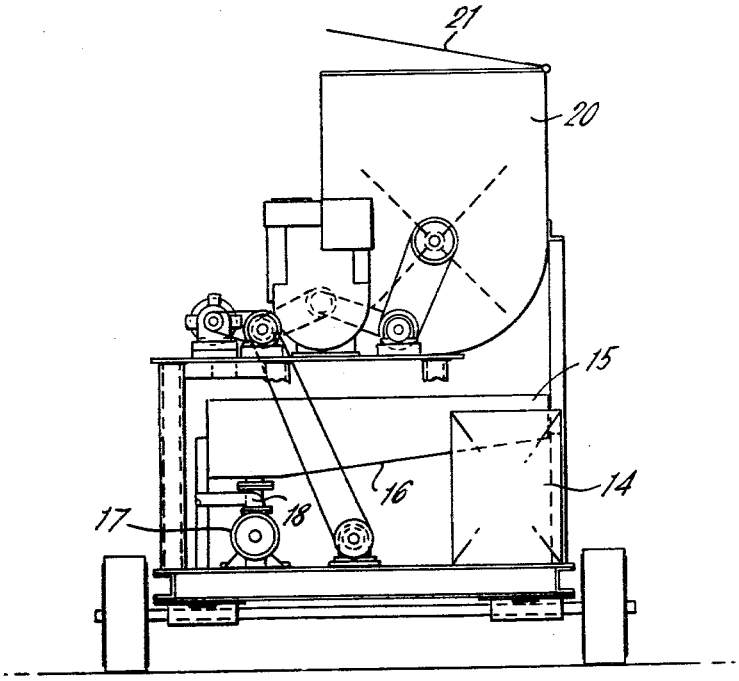
FIG. 4 is an end view of the apparatus of FIGS. 1, 2 and 3.

Referring first to FIG. 1 there is illustrated a trailer 10 provided with four road wheels 11 and conventional steadying jacks 12 as well as a ball-type hitch 13. Mounted on the lower deck of the trailer is a water tank 14 and an open topped hold tank 15 having an inclined lower surface 16. At the lefthand side, as seen in FIG. 4, a helical gear feed pump 17 is connected to the bottom of the tank and has an outlet pipe 18, the pump being driven by a nine horsepower Briggs and Stratton petrol engine 19 provided with a reduction gear box.

Figure 5:
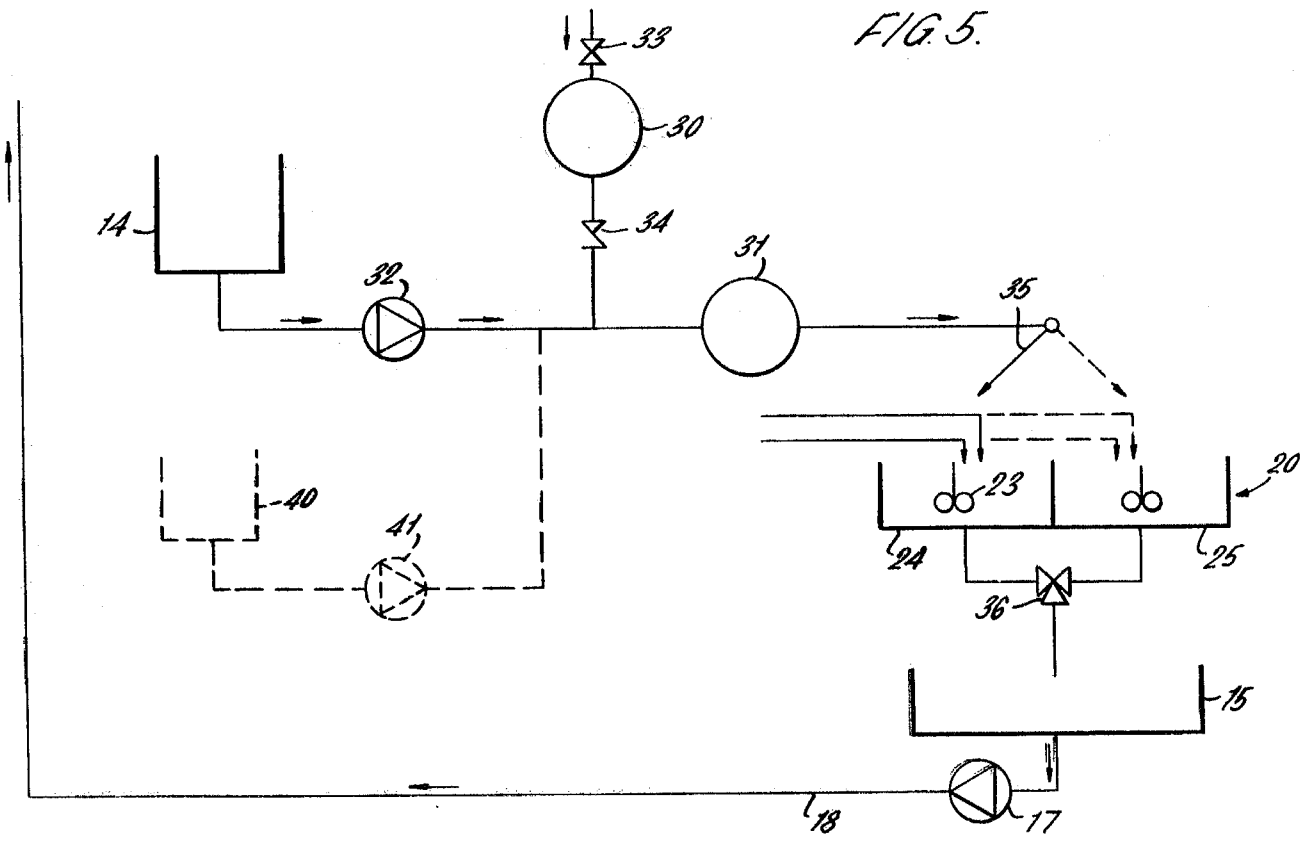
FIG. 5 is a flow diagram illustrating the feed arrangement of the apparatus of FIGS. 1 to 4.

Mounted on the upper deck is a slurry tank 20 having a hinged lid 21 and having a horizontally extending shaft 22 therein carrying paddles 23. The tank is divided into two chambers 24 and 25 by a partition wall 26. In order to drive the shaft 22 a second petrol engine 27 is provided, this being of the same type as the engine 19. The paddle shaft 22 is driven via belting indicated by the general reference numeral 28 and a further shaft 29 carries pulleys to drive the other components of the apparatus. Mounted adjacent the shaft 29 is a compressor 30 and an Oakes foaming unit 31 while on the bottom deck is a water pump 32 which again is a small Mono pump. Referring to FIG. 5, the connection to the various components are illustrated. Thus the water tank 14 is connected via the water pump 32 to foaming units 31 and the compressor 30 is also connected thereto. A control valve 33 is provided at the inlet of the compressor and the outlet has a non-return valve 34. The control valve 33 controlling the supply of air to the foaming unit 31. The outlet of the foaming unit is connected via a flexible hose 35 alternately either to the chamber 24 or the chamber 25. The two chambers are connected via a three-way valve 36, so that one chamber can be emptied at a time and the outlet of the three-way valve feeds the cement mixture to the hold tank 15. From the bottom of the hold tank 15 the pump 17 pumps the resulting mixture via the outlet pipe 18.

In use, to produce a particular type of product, 68 liters of water and foaming agent are handmixed and placed in tank 14 and the pump 32 is operated at 270 liters/hour. The air compressor, which can pump at a maximum of 7800 standard liters/hour feeds air through the non-return valve 34 to the foaming unit and the water is increased in volume be between 35 and 100 times by the action of the foaming agent. A premixed quantity of cement powder and water has been placed in the tank chamber 24 and the flexible hose 25 is directed to the left as shown in full-line so that it introduces the material into the chamber 24. The paddles 23 cause a thorough mixing of the cement and foam and a foamed cement is thereby produced. Meanwhile, a further quantity of cement and water mix is introduced into the chamber 25. The valve 36 is then opened to empty the mixture from the chamber 24 into the holding tank 15 the flexible hose 35 having by this time been introduced into the chamber 25. The cement water mix is at the rate 3,000 kilogrammes of cement per hour and 1500 to 1800 liters of water/hour. The hold tank contains temporarily the mixture emptied from the chamber 24 and the pump 17 is operated to feed the material to the site location.

The valve 36 is then moved to the other direction so that chamber 25 is emptied, the chamber 24 having meanwhile been filled again with the cement mixture. FIG. 5 only illustrates a further facility in which a further tank 40 to contain a water repellent solution is provided on the chassis, this having a further Mono pump 41 connected to its outlet, to supply water repellant to the foaming unit at the same time as the water foaming agent solution. The purpose of introducing the water repellent is to make the resulting foam cement at the outlet of the apparatus itself water repellent so that is can withstand adverse weather conditions. Ordinary foam cement can be absorbent and can therefore produce an unsatisfactory product for a building if the insulating material is on the roof, for example. The apparatus of the present invention is primarily intended to insulate the roof of the building both against intense heat and intense cold. It is contemplated that the foam cement from the outlet pipe 18 should be spread in layers approximately 3 inches thick. The pump 17 is capable of pumping to a considerable height for example up to 100 ft. so that the apparatus can be utilised for installation of roof covering for tall buildings. If further height is required a further pump could be provided at a location up the building.

As indicated previously, the control of the foam density and/or the cell size can be effected by operating the control valve 33. Alternatively or additionally, control of the cell size and/or foam density can be effected by choosing a suitable construction of the foam producing unit 31. Thus, if it is a unit including packing, a suitable type of packing can be chosen for a particular task. Similarly, a different type of unit may be utilised and if an Oakes type mixer is used the parameters of this mixer and/or its speed of operation can be controlled.

We claim:

1. Apparatus for producing an insulating material comprising a supply tank for water and wetting agent, a compressor for producing a compressed air supply, a foaming unit connected to the compressor and supply tank, a batch accumulator slurry tank including two tank portions separated by a vertical partition, an agitator comprising a shaft rotatable about a horizontal axis, spaced apart radial extending paddles on said agitator shaft in each tank section, an outlet pipe for each tank section, a valve in each outlet pipe effective to allow material to be discharge alternately from each tank section, a connection between the foaming unit and the slurry tank alternately positionable to feed foam to one tank section or the other and a feed pump for feeding the resulting mixture from each slurry tank section to a point of use.

2. Apparatus as claimed in claim 1 and further comprising a hold tank positionable to receive material from both the said outlet pipes and wherein said feed pump is connected to said hold tank.

* * * * *